US005921403A

United States Patent [19]

Coffaro

[11] Patent Number: 5,921,403

[45] Date of Patent: Jul. 13, 1999

[54] RACK SYSTEM FOR BASEBALL-STYLE CAPS

[76] Inventor: Ronald Coffaro, 2218 Flomar Ct., Cincinnati, Ohio 45233

[21] Appl. No.: 08/938,273

[22] Filed: Sep. 26, 1997

[51] Int. Cl.[6] ..... A47F 7/06

[52] U.S. Cl. ..... 211/32; 211/30; 211/87.01

[58] Field of Search ..... 211/30, 31, 32, 211/33, 87.01

[56] References Cited

U.S. PATENT DOCUMENTS

| | | | |
|---|---|---|---|
| 4,805,782 | 2/1989 | Hale et al. | 211/30 |
| 5,038,941 | 8/1991 | Bastiaansen | 211/32 |
| 5,188,325 | 2/1993 | Hilty et al. | 248/224.4 |
| 5,209,382 | 5/1993 | Chang | 211/87.01 X |
| 5,240,123 | 8/1993 | Hawk | 211/32 |
| 5,303,829 | 4/1994 | Kennedy | 211/30 |
| 5,396,994 | 3/1995 | Fitzgerald | 211/32 |
| 5,411,144 | 5/1995 | Deupree | 211/30 |
| 5,450,967 | 9/1995 | Mallory | 211/30 |
| 5,624,041 | 4/1997 | Van Druff, Jr. et al. | 211/30 |
| 5,628,414 | 5/1997 | Heathcote | 211/87.01 X |
| 5,645,178 | 7/1997 | Conley, Jr. | 211/87.01 |

*Primary Examiner*—Blair M. Johnson
*Attorney, Agent, or Firm*—Wood, Herron & Evans, LLP

[57] ABSTRACT

A rack system for the removable storage and display of baseball-style caps is provided. The rack system includes an elongated support member which is adapted to be mounted on a wall or similar structure through suitable fasteners. A series of spaced retainers are preferably integrally formed on the elongated support member and extend forwardly therefrom in either spaced vertical or horizontal arrangement. The retainers each include a slot which extends rearwardly through the retainer a predetermined depth toward the elongated support member. A series of cap mounts are provided which are preferably configured to support a front portion of a baseball-style cap and to receive a rear portion of the cap within the cap mount. The cap mounts are removably engagable with the slots in the retainers to store and display the baseball-style caps in either of the spaced vertical or horizontal arrangements.

20 Claims, 3 Drawing Sheets

RACK SYSTEM FOR BASEBALL-STYLE CAPS

FIELD OF THE INVENTION

The present invention relates generally to cap display systems and, more particularly, to a rack system for the removable storage and display of baseball-style caps in spaced vertical or horizontal arrangements on a wall or similar structure.

BACKGROUND OF THE INVENTION

Baseball-style caps have become increasingly popular for both wear and display as new sports team emerge with distinctive team emblems and more companies advertise their corporate name or logo on the brow of such caps. It will be appreciated that baseball-style caps typically include a flexible cloth-like body portion which is adapted to be worn by the wearer, a bill facing forwardly of the cap body, and some type of indicia on the brow of the cap related to a sports team, corporate identity or social expression, for example.

With the popularity of baseball-style caps having colorful or unique indicia on the brow, collectors of such caps typically desire to display their caps on a wall for others to view and enjoy. An important aspect of any cap display is the ability to easily see the indicia on the brow of the cap. Moreover, as the caps may also be worn by the collector from time-to-time, it is also desirable in a cap display system to maintain the structural integrity and shape of the caps while they are being stored and displayed on the wall.

Rack systems have been developed in the past to serve the dual purpose of storage and display of baseball-style caps on a wall or similar structure. Examples of several known display systems include U.S. Pat. No. 5,396,994 to Fitzgerald, U.S. Pat. No. 5,303,829 to Kennedy, U.S. Pat. No. 5,295,588 to Neirinckx, U.S. Pat. No. 5,038,941 to Bastiaansen, U.S. Pat. Nos. 5,188,325 and 4,673,153 to Hilty et al., U.S. Pat. No. 5,240,123 to Hawk, U.S. Pat. No. 4,583,646 to Bowman and Des. U.S. Pat. No. 324,960 to Rodack.

However, notwithstanding the developments in the prior art of rack systems for the storage and display of baseball-style caps on a wall, there exists a need for a rack system which is easy to assemble and disassemble for the removable storage and display of baseball-style caps on a wall. There is also a need for a rack system which facilitates viewing of the baseball-style caps in an organized manner while at the same time maintaining the structural integrity and shape of the caps as they are being displayed. There is yet another need for a rack system which offers flexibility for configuring the rack system to meet a wide variety of storage and display needs of a collector.

SUMMARY OF THE INVENTION

To these ends, the rack display system of the present invention is adapted to be mounted on a wall or similar vertical support structure for the removable storage and display of baseball-style caps. The rack system of the present invention is adapted to display the baseball-style caps in an organized manner on the wall, in either spaced vertical or horizontal arrangement, while at the same time maintaining the structural integrity and shape of the caps as they are being displayed. The construction of the rack system provides versatility for configuring the rack system to meet the display needs of a user.

The rack system preferably includes an elongated support member which is mounted to a wall or similar structure through suitable fasteners. A series of spaced retainers are preferably integrally formed on the elongated support member and extend forwardly therefrom in either spaced vertical or horizontal arrangement. The retainers each include a slot which extends through the retainer rearwardly a predetermined depth toward the elongated support member. A series of cap mounts are provided which are configured to support a front portion of a baseball-style cap and to receive a rear portion of the cap within the cap mount. Preferably, the bill on the cap is supported by a support element which extends forwardly of the cap mount.

In accordance with the present invention, the cap mounts are removably engagable with the slots in the retainers to store and display the baseball-style caps in either spaced vertical or horizontal arrangement on the rack system. In one embodiment, the cap mounts include a pair of spaced upwardly directed slots in a rearward portion of the cap mounts to engage side portions of the caps. In this way, the caps are stored and displayed in an organized manner on a wall while at the same time, the original shape of the caps is maintained to prevent crushing or sagging of the caps.

The above features and advantages of the present invention will become more readily apparent with reference to the accompanying figures and detailed description.

BRIEF DESCRIPTION OF THE DRAWINGS

Reference will now be made to the accompanying figures from which the novel features and advantages of the present invention will be apparent.

DETAILED DESCRIPTION OF THE PREFERRED EMBODIMENTS

Figure 1:
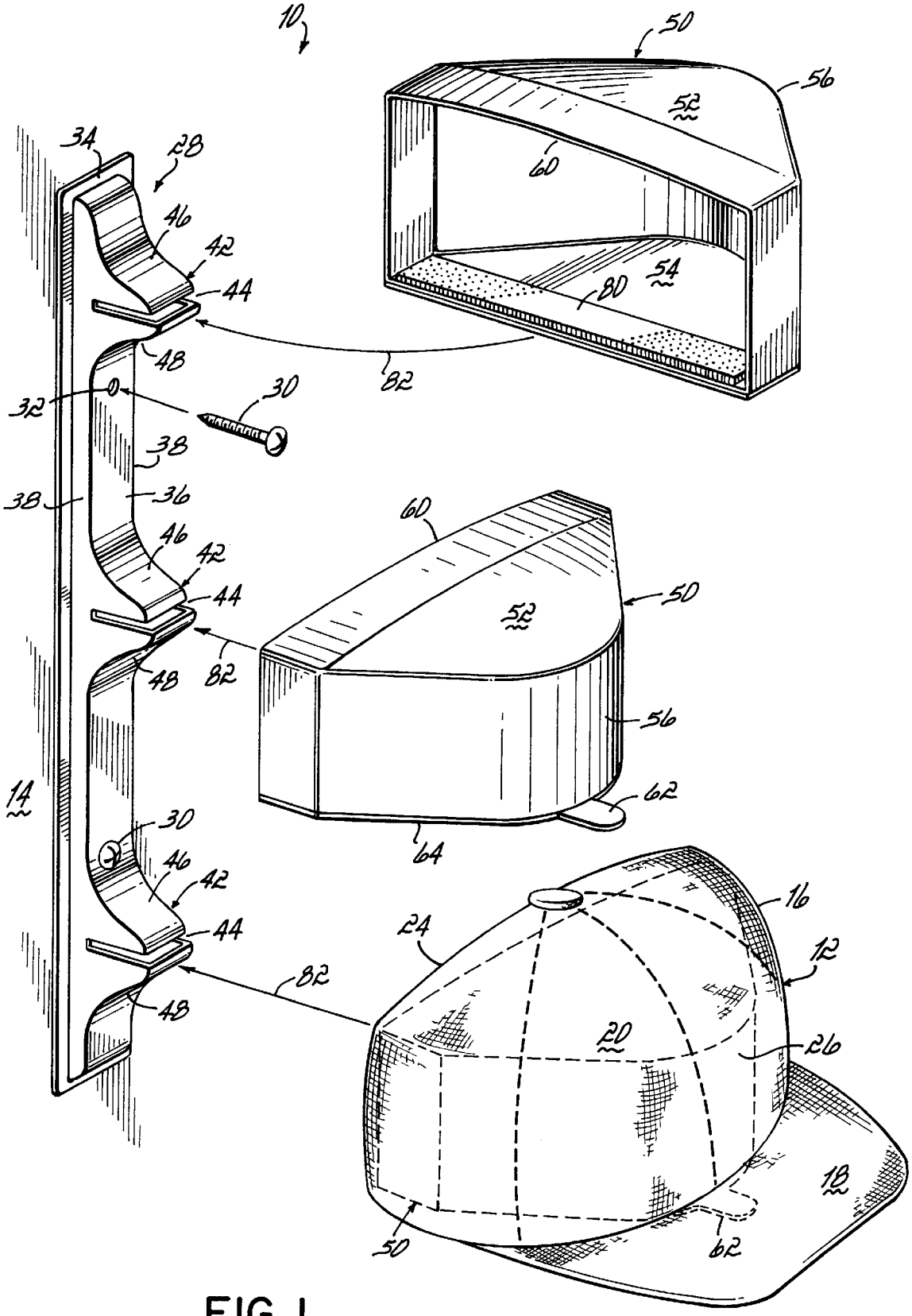
FIG. 1 is a disassembled perspective view of a rack system in accordance with one embodiment of the present invention for storage and display of baseball-style caps in a vertical arrangement.
Figure 2:
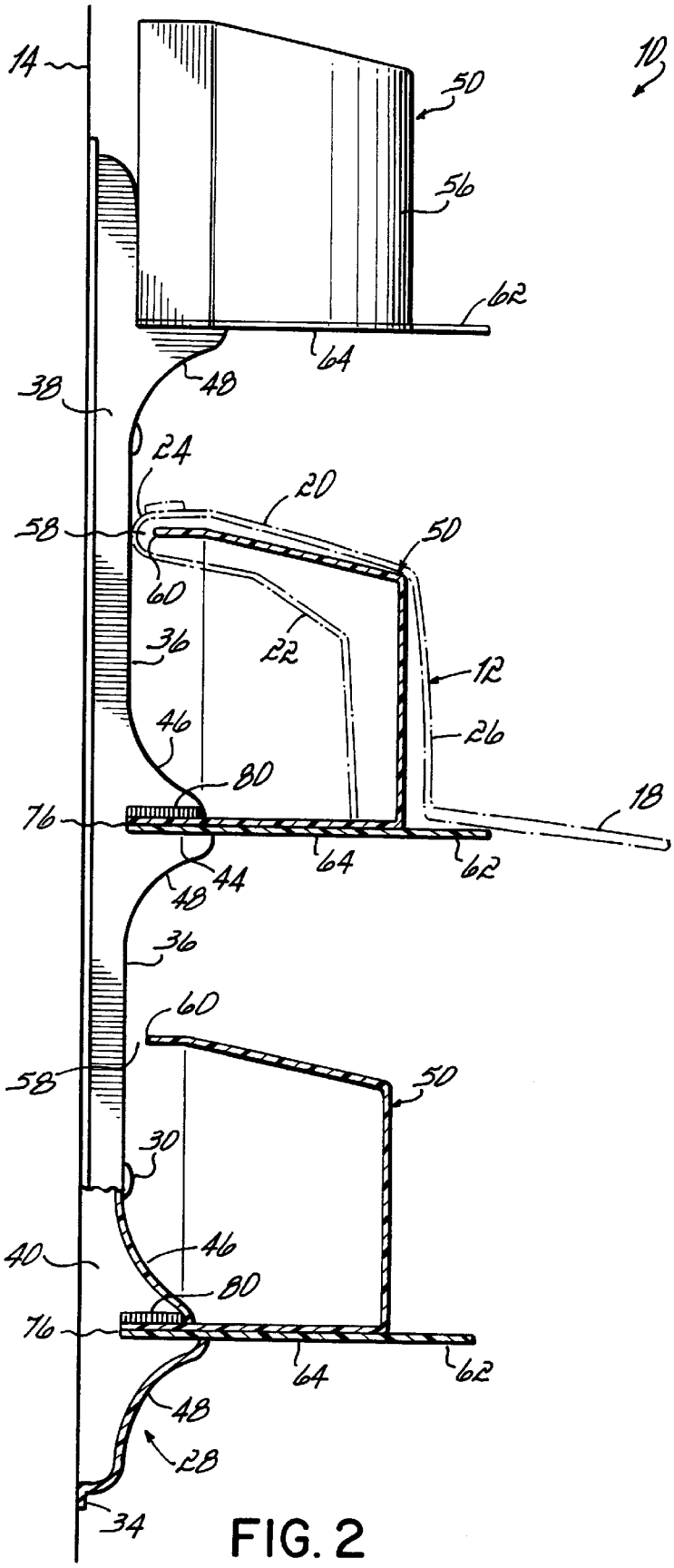
FIG. 2 is a side elevational view, in partial cross-section, of the rack system shown in FIG. 1.
Figure 5:
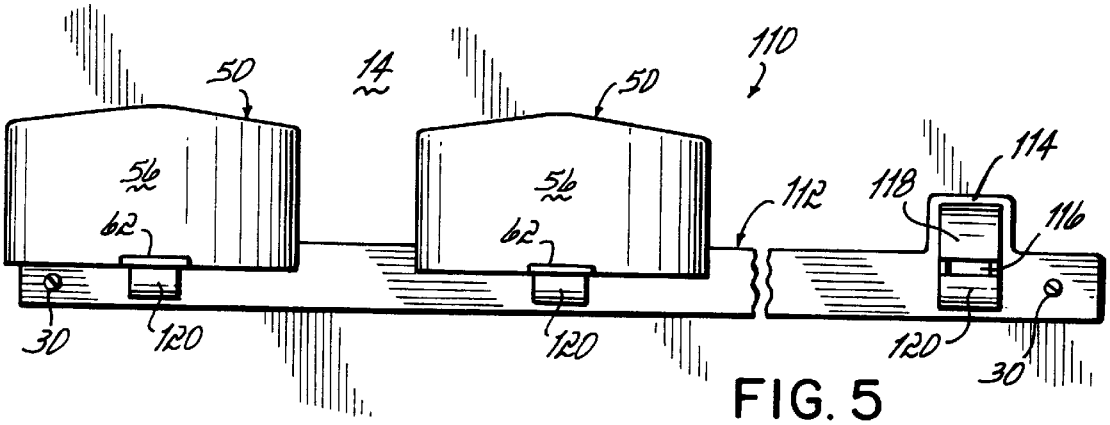
FIG. 5 is a front elevational view of a rack system in accordance with an alternative embodiment of the present invention for storage and display of baseball-style caps in a horizontal arrangement.

With reference to the figures, and to FIG. 1 in particular, a rack system 10 in accordance with one embodiment of the present invention is shown for removable storage and display of baseball-style caps 12 on a wall or similar vertical support structure 14. Rack system 10 is configured for storing and displaying baseball-style caps 12 in spaced vertical arrangement as shown most clearly in FIGS. 1 and 2, or, alternatively, in spaced horizontal arrangement as shown in FIG. 5. In either of the alternative embodiments shown, rack system 10 provides removable storage and display of caps 12 in an organized manner while at the same time maintaining their structural integrity and shape, as will be described in more detail below.

It will be appreciated that conventional baseball-style caps, such as caps 12, have a body 16 made of a flexible cloth-like material which is configured to receive a portion of a wearer's head. A visor or bill 18 extends forwardly from a front portion 20 of the cap and, as a result of the flexible nature of the cap body, a rear portion 22 of the cap body is capable of being folded along foldline 24 (see FIG. 1) in opposed relation within the front portion of the cap body as shown most clearly in FIGS. 2 and 4. While not shown, it will be appreciated that logos, team emblems, corporate names or other indicia are typically displayed on the front portion 20 of the cap 12, such as on brow 26.

In accordance with the present invention, rack system 10 includes an elongated support member 28, preferably made of lightweight molded thermoplastic material, which is mounted on the wall 14 through fasteners 30 which extend through apertures 32 (only one shown in FIG. 1) formed in the elongated support member. Preferably, the elongated support member 28 has a substantially planar rearward flange 34 for abutment with the wall 14, a contoured forward surface 36, and a pair of side surfaces 38. While the planar rearward flange 34, contoured forward surface 36 and pair of side surfaces 38 preferably define a cavity 40 in the elongated support member 28 (see FIG. 2) to minimize its weight while providing necessary structural rigidity, it will be appreciated that other materials and structures are readily available for the manufacture of the elongated support member 28 as described below.

With further reference to FIG. 1, a series of spaced retainers 42 are preferably integrally formed on the elongated support member 28 and extend forwardly therefrom and away from the wall 14. Each of the retainers 42 has a slot 44 which extends rearwardly through the retainer a predetermined depth toward the elongated support member 28. Preferably, the slots 44 are disposed generally perpendicularly to the longitudinal axis of the elongated support member 28, and the retainers 42 each have an upper section 46 disposed above the slot, and a lower section 48 disposed below the slot. The lower section 48 preferably extends forwardly beyond the upper section 46 to ease assembly of the rack system 10 as will be described in more detail below. Additionally, the upper section 46 may include a chamfer (not shown) leading into the slot 44 to further ease assembly of the rack system 10. It is contemplated that elongated support members 28 may be manufactured with varying numbers of spaced retainers 42. For example, the elongated support members 28 may have one, two or three retainers 42, which may be mixed and matched on a wall, to provide custom configurations of rack systems 10 for the storage and display of baseball-style caps 12.

Further referring to FIG. 1, rack system 10 includes a series of cap mounts 50, also preferably made of lightweight molded thermoplastic material, for removable storage and display of the baseball-style caps 12 on the elongated support member 28. Each of the cap mounts 50 preferably comprises a shell having a rounded or contoured top surface 52, a planar bottom surface 54, and a generally convex surface 56 extending forwardly about the cap mount. The cap mounts 50 are preferably adapted to support the front portion 20 of caps 12, i.e., the front interior of the caps, and to receive the rear portion 22 of the caps within the shell, as shown most clearly in FIGS. 2 and 4. In this way, the cap mounts 50 maintain the shape of the caps 12 while the caps are stored and displayed by the rack system 10. A small gap 58 (see FIG. 2) is provided between a rearward edge 60 of the top surface 52 of cap mount 50 and the elongated support member 28 to accommodate folding of the rear portion 22 of cap body 16 within the shell.

Figure 3:
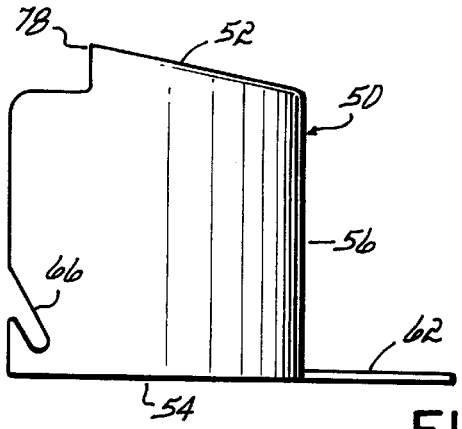
FIG. 3 is a side elevational view of one embodiment of a cap mount for use in the rack system of FIG. 1.

Preferably, a support element 62 extends forwardly from a front portion of the cap mount 50, i.e., from the convex surface 56, to support the bill 18 of cap 12. The support element 62 is preferably integrally formed on a rigid plate member 64, also preferably made of thermoplastic material, which has generally the same peripheral configuration as the bottom surface 54 of cap mount 50 except for the forwardly extending support element. The rigid plate member 64 is preferably fastened to the bottom surface 54 of cap mount 50 through double-sided tape or sonic welding to add structural rigidity to the bottom surface of the cap mount, in addition to providing the forwardly extending support element 62. As shown in FIG. 3, it is also contemplated in an alternative embodiment that the support element 62 may be integrally formed as part of the cap mount 50 such that the rigid plate member 64 could be dispensed with in its entirety.

Figure 4:
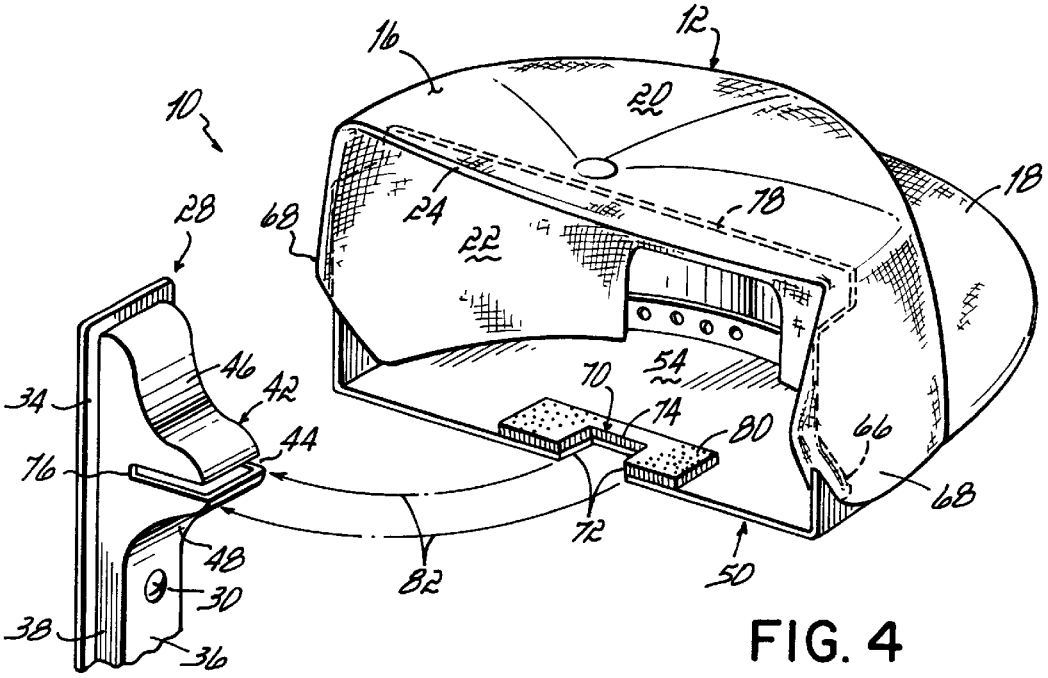
FIG. 4 is a partial perspective view showing assembly of the rack system of FIG. 1.

As shown most clearly in the alternative embodiments of FIGS. 3 and 4, the cap mounts 50 preferably include a pair of spaced upwardly directed slots 66 disposed in a rearward portion of the cap mount for engaging side portions 68 of the baseball-style cap 12. In the embodiment shown in FIG. 4, the bottom surface 54 of cap mount 50 preferably includes a notch 70 which is adapted to be engaged in the slot 44 for providing proper registration of the cap mount relative to the elongated support member 28. In this way, parallel edges 72 of notch 70 engage the side surfaces 38 of elongated support member 28 to center the cap mount 50 relative thereto. Transverse edge 74 of notch 70 engages an inward edge 76 of slot 44 (see FIG. 4) to limit insertion of the cap mount 50 into the slot. To provide the desired gap between the cap mount 50 and the elongated support member 28 when the notch 70 is engaged in the slot 44, a notch 78 (see FIG. 4) is provided in the top surface 52 of cap mount 50 to accommodate receiving the rear portion 22 of cap body 16 within the shell. Preferably, as shown most clearly in FIGS. 1, 2 and 4, a strip of Velcro® 80 or similar material is adhered to the bottom surface 54 of cap mount 50 within the shell to provide frictional engagement between the bottom surface of the cap mount and the upper section 46 of retainer 42 as the cap mount is inserted into the slot 44.

In use, the elongated support members 28 are mounted in a desired configuration to wall 14 through the fasteners 30 which extend through apertures 32 formed in the elongated support members. Baseball-style caps 12 are placed over cap mounts 50, with the top surface 52 of each cap mount preferably supporting the front portion 20 of cap body 16 and the support element 62 supporting the bill 18 of the cap. The side portions 68 of caps 12 are engaged in the spaced upwardly directed slots 66 of cap mounts 50, and the rear portion 22 of the cap body is folded along foldline 24 to be received within the shell of the cap mount as shown most clearly in FIGS. 2 and 4.

The cap mounts 50 are inserted into the spaced retainers 42, in a direction represented by arrows 82 in FIGS. 1 and 4, with their respective notches 70 in registry with and engaging the respective slots 44 in the spaced retainers. The extension of the lower section 48 of retainer 42 beyond the upper section 46 facilitates assembly of the rack system 10 by providing a "catch" to register the cap mount 50 with the slot 44. When the cap mounts 50 are fully inserted in the slots 44, the bottom surface 54 of each cap mount is supported on the lower section 48 of retainer 42 and the Velcro® strip 80 frictionally engages the upper section 46 of the retainer to maintain engagement between the cap mounts and the elongated support member 28. The notches 70 assure proper registration of the cap mounts 50 relative to the elongated support member 28. It will be appreciated that more baseball-style caps 12 may be displayed in vertical arrangement by rack system 10 merely by adding one or more elongated support members 28 along a common longitudinal axis. In accordance with the present invention, the rack system 10 thus provides removable storage and display of baseball-style caps 12 in an organized manner while maintaining the structural integrity and shape of the caps.

As shown in FIG. 5, an alternative embodiment of the rack system 10 is shown as rack system 110. In this embodiment, an elongated support member 112 is provided having spaced retainers 114 (one shown) disposed in spaced horizontal arrangement. Each of the retainers 114 has a slot 116 which extends therethrough rearwardly a predetermined depth toward the elongated support member 112. Preferably, the slots 116 are disposed generally parallel to the longitudinal axis of the elongated support member 112, and the retainers 114 each have an upper section 118 disposed above the slot, and a lower section 120 disposed below the slot. The lower section 120 preferably extends forwardly beyond the upper section 118 to ease assembly of the rack system 110 as described in detail above. As discussed above in detail with regard to the embodiments shown in FIGS. 1–4, a series of cap mounts 50 are adapted to be received in the slots 116 for supporting the baseball-style caps 12 in spaced horizontal arrangement on wall 14. The elongated support members 112 may have one, two or three spaced retainers 114, for example, which may be mixed and matched on a wall, to provide custom configurations of rack systems 110 for the storage and display of baseball-style caps 12.

Those skilled in the art will readily appreciate that the present invention provides a convenient rack system for the removable storage and display of baseball-style caps. The rack display system serves the dual purpose of displaying the caps in an organized manner while at the same time maintaining the structural integrity and shape of the caps. The construction of the rack system provides flexibility for configuring the rack system to meet a wide variety of storage and display needs of a user.

From the above disclosure of the general principles of the present invention and the preceding detailed description of preferred embodiments, those skilled in the art will readily comprehend the various modifications to which the present invention is susceptible. For example, it is contemplated that the elongated support members 28 and 112 could be manufactured of wood, metal, hardened resins or other moldable materials without departing from the spirit and scope of the present invention. Moreover, while it is preferred that the spaced retainers are integrally formed on the elongated support member 28, it is contemplated that the retainers 42 could likewise be non-integral components which are attached to the elongated support member 28. Additionally, while the cap mounts 50 have been shown and described as comprising a shell having a top surface 52, a bottom surface 54 and a convex surface 56 extending thereabout, it is contemplated that the cap mounts may be configured in a multitude of other shapes which are adapted to preferably support the front portion 20 of caps 12. Thus, the invention in its broader aspects is therefore not limited to the specific details and illustrative examples shown and described. Accordingly, departures may be made from such details without departing from the spirit or scope of Applicant's general inventive concept. Therefore, Applicant desires to be limited only by the scope of the following claims and equivalents Having described the invention, I claim:

1. A rack system for removable storage and display of baseball-style caps, each of said caps having a body configured to receive a portion of a wearer's head, a bill extending forwardly from a front portion of the cap body, and the cap body being capable of being folded with a rear portion of the cap body received in opposed relation within the front portion of the cap body, said rack system comprising:

an elongated support member;

a plurality of retainers spaced on said elongated support member, said retainers each having respective slots extending therethrough rearwardly a predetermined depth; and a plurality of cap mounts removably engageable with respective ones of said slots, each of said cap mounts including a shell having a top surface, a bottom surface spaced from said top surface and adapted to engage one of said slots, and a generally convex surface extending forwardly between said top and bottom surfaces, whereby each of said cap mounts is adapted to support the front body portion of a cap and receive the rear body portion of the cap within the shell.

2. The rack system of claim 1 wherein each of said slots defines a plane, wherein said plane is disposed generally perpendicularly to the longitudinal axis of said elongated support member.

3. The rack system of claim 1 wherein each of said slots defines a plane, wherein said plane is disposed generally parallel to the longitudinal axis of said elongated support member.

4. The rack system of claim 1 wherein said retainers are integrally formed on said elongated support member.

5. The rack system of claim 1 wherein said retainers extend forwardly from said elongated support member.

6. The rack system of claim 1 wherein each of said cap mounts includes a support element extending forwardly therefrom for supporting the bill on said baseball-style caps.

7. The rack system of claim 1 wherein each of said bottom surfaces includes a notch adapted to be slidably engaged in respective ones of said slots for registration of said cap mounts relative to said elongated support member.

8. The rack system of claim 1 wherein each of said cap mounts includes a pair of spaced upwardly directed slots disposed in a rearward portion thereof for engaging side portions of said cap.

9. The rack system of claim 2 wherein said retainer includes an upper section disposed above said slot and a lower section disposed below said slot wherein said lower section extends forwardly beyond said upper section.

10. The rack system of claim 3 wherein said retainer includes an upper section disposed above said slot and a lower section disposed below said slot wherein said lower section extends forwardly beyond said upper section.

11. A rack system for removable storage and display of baseball-style caps, each of said caps having a body configured to receive a portion of a wearer's head, a bill extending forwardly from a front portion of the cap body, and the cap body being capable of being folded with a rear portion of the cap body received in opposed relation within the front portion of the cap body, said rack system comprising:

an elongated support member;

a plurality of spaced retainers integrally formed on said elongated support member and extending forwardly therefrom, said retainers each having respective slots extending therethrough rearwardly a predetermined depth toward said elongated support member; and a plurality of cap mounts removably engageable with respective ones of said slots, each of said cap mounts including a shell having a top surface, a bottom surface spaced from said top surface and adapted to engage one of said slots, and a generally convex surface extending forwardly between said top and bottom surfaces, whereby each of said cap mounts is adapted to support the front body portion of a cap and receive the rear body portion of the cap within the shell.

12. The rack system of claim 11 wherein each of said slots defines a plane, wherein said plane is disposed generally perpendicularly to the longitudinal axis of said elongated support member.

13. The rack system of claim 11, wherein each of said slots defines a plane, wherein said plane is disposed generally parallel to the longitudinal axis of said elongated support member.

14. The rack system of claim 11 wherein each of said cap mounts includes a support element extending forwardly therefrom for supporting the bill on said baseball-style caps.

15. The rack system of claim 11 wherein each of said bottom surfaces includes a notch adapted to be slidably engaged in respective ones of said slots for registration of said cap mounts relative to said elongated support member.

16. The rack system of claim 11 wherein each of said cap mounts includes a pair of spaced upwardly directed slots disposed in a rearward portion thereof for engaging side portions of said cap.

17. The rack system of claim 12 wherein said retainer includes an upper section disposed above said slot and a lower section disposed below said slot wherein said lower section extends forwardly beyond said upper section.

18. The rack system of claim 13 wherein said retainer includes an upper section disposed above said slot and a lower section disposed below said slot wherein said lower section extends forwardly beyond said upper section.

19. A rack system for removable storage and display of baseball-style caps, each of said caps having a body configured to receive a portion of a wearer's head, a bill extending forwardly from a front portion of the cap body, and the cap body being capable of being folded with a rear portion of the cap body received in opposed relation within the front portion of the cap body, said rack system comprising:

an elongated support member;

a plurality of retainers spaced on said elongated support member, said retainers each having respective slots extending therethrough rearwardly a predetermined depth; and a plurality of cap mounts removably engageable with respective ones of said slots, each of said cap mounts including a shell having a top surface, a bottom surface spaced from said top surface and having a notch adapted to be slidably engaged in one of said slots for registration of said cap mount relative to said elongated support member, and a generally convex surface extending forwardly between said top and bottom surfaces, whereby each of said cap mounts is adapted to support the front body portion of a cap and receive the rear body portion of the cap within the shell.

20. A rack system for removable storage and display of baseball-style caps, each of said caps having a body configured to receive a portion of a wearer's head, a bill extending forwardly from a front portion of the cap body, and the cap body being capable of being folded with a rear portion of the cap body received in opposed relation within the front portion of the cap body, said rack system comprising:

an elongated support member;

a plurality of spaced retainers integrally formed on said elongated support member and extending forwardly therefrom, said retainers each having respective slots extending therethrough rearwardly a predetermined depth toward said elongated support member; and a plurality of cap mounts removably engageable with respective ones of said slots, each of said cap mounts including a shell having a top surface, a bottom surface spaced from said top surface and having a notch adapted to be slidably engaged in one of said slots for registration of said cap mount relative to said elongated support member, and a generally convex surface extending forwardly between said top and bottom surfaces, whereby each of said cap mounts is adapted to support the front body portion of a cap and receive the rear body portion of the cap within the shell.

* * * * *